US006332837B1

(12) United States Patent
Wilk et al.

(10) Patent No.: US 6,332,837 B1
(45) Date of Patent: Dec. 25, 2001

(54) DEVICE FOR THE REMOVAL OF GAS AND PARTICLES FORMED DURING WELDING AND CUTTING JOBS

(76) Inventors: Vidar Wilk, N-5437, Finnås; Reidar V., Stølane 21, N-5430 Bremnes, both of (NO)

( * ) Notice: Subject to any disclaimer, the term of this patent is extended or adjusted under 35 U.S.C. 154(b) by 0 days.

(21) Appl. No.: 09/403,054

(22) PCT Filed: Apr. 7, 1998

(86) PCT No.: PCT/NO98/00116

§ 371 Date: Nov. 23, 1999

§ 102(e) Date: Nov. 23, 1999

(87) PCT Pub. No.: WO98/46375

PCT Pub. Date: Oct. 22, 1998

(30) Foreign Application Priority Data

Apr. 14, 1997 (NO) ..... 971697

(51) Int. Cl.[7] ..... B08B 15/04
(52) U.S. Cl. ..... 454/63; 219/137.41; 454/49
(58) Field of Search ..... 454/49, 63; 219/134.41

(56) References Cited

U.S. PATENT DOCUMENTS 2,397,197 * 3/1946 Newman ..... 454/49 X
3,797,205 * 3/1974 Weisskopf ..... 454/49 X
4,058,299 * 11/1977 Lindkvist .
4,287,405 * 9/1981 Ohmae et al. ..... 454/63 X
4,451,000 * 5/1984 Stephens ..... 454/49 X
4,502,179 * 3/1985 Coughlin et al. .
5,941,766 * 8/1999 Iversen ..... 454/63 X

FOREIGN PATENT DOCUMENTS

1719166 * 3/1992 (RU) ..... 219/137.41

* cited by examiner

*Primary Examiner*—Harold Joyce
(74) *Attorney, Agent, or Firm*—Francis G. Hand; Carella, Byrne et al.

(57) ABSTRACT

An arrangement for removing gas, smoke, solid particles and the like in connection with welding and/or cutting consisting of two parts which can be easily latched together, namely an outer housing and an inner part. The outer housing comprises a unit for the suction of air-borne pollutants, and also a duct arranged with small opening for cooling fluid to escape for cooling both the outer housing and the inner part. A pyramidal shaped structure within the housing for assisting the reduction of the speed and energy of the spark particles formed during welding or cutting.

5 Claims, 6 Drawing Sheets

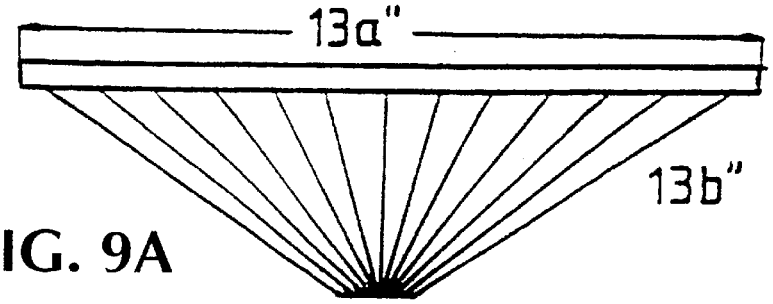
FIG. 9A
FIG. 9B
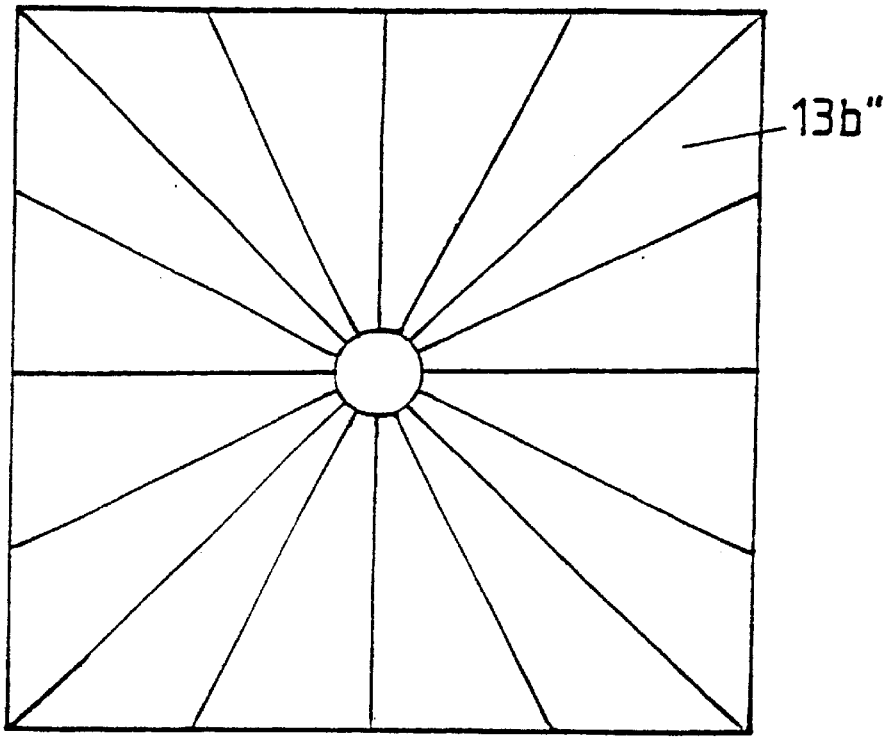
FIG. 9C
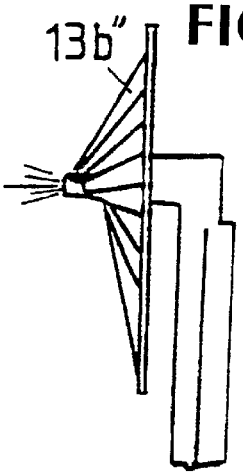
FIG. 9D
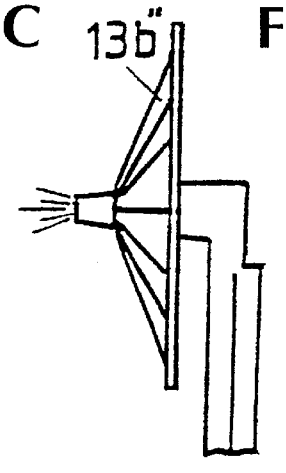

DEVICE FOR THE REMOVAL OF GAS AND PARTICLES FORMED DURING WELDING AND CUTTING JOBS

The present invention relates to an arrangement for removing gas, smoke, solid particles, such as sparks and the like, in connection with welding and/or cutting burning.

On conducting different types of welding work gases and smoke are formed which are harmful to the person who performs the working operation Particularly on the welding of dissimilar metal alloys gases will be formed which are dangerous to the health. In addition gases and smoke which are formed will reduce visibility in the welding area.

On cutting metal various types of cutting machines and cutting burners are used. Also in these working processes gases and smoke are formed which are harmful, in addition to there being formed large quantities of sparks, which are small, very warm particles. Microparticles are also Formed which are too small to be seen, and these are transported by air currents into the body of the worker where they cause great harm.

It is therefore necessary to remove these gases and particles in an effective manner. Various methods have been tested. For example the general circulation in the building can be increased. However this creates other problems, such as noise, drafts and high energy consumption.

Another solution is to use point suction which is mounted above the welding/cutting point and which has as an object to suck in the gases/particles which are formed. However the problem is not solved satisfactorily since the gases/particles are sucked from the working area and upwards to the point auction, that is to say past the person who performs the work.

NO-63259 describes a work table which is used in welding work and the like, where the board per se is equipped with openings, and where the gases are sucked downwards through the openings by a suction flow which is arranged on the under side of the board.

NO-143:35 describes a broken through work board for cutting operations where there is arranged beneath the board a suction arrangement. Furthermore the suction box is provided with means for the reduction of the speed of jets/sparks, and means for cooling.

The solutions referred to are both designed for permanent mounting in for example plant halls. Both of the solutions are large and complicated constructions, and cannot be easily moved from one working location to another.

The present invention aims therefore to reduce or solve the afore-mentioned problems which are connected with welding/cutting. More specifically, this involves producing an effective system for removing gases/particles, together with a system for the reduction of the speed of sparks, and the cooling of these, and furthermore that the system is constructed with a low net weight and small dimensions, so that the arrangement is mobile and can be moved in a simple manner from one working location to another.

An embodiment of the present invention is characterised by the arrangement comprising in the main two parts, which can be easily latched together, namely an outer housing and an inner part, wherein the outer housing comprises means for drawing off air-borne pollutants, together with means for cooling both the outer housing and the inner part, and where the inner part is adapted to reduce the energy of the spark particles which are formed. Another embodiment is characterised by the arrangement being detachably fastened to the material which is to be welded/cut, and that the welding/cutting takes place within said arrangement, the arrangement being provided with openings, for conducting through equipment for welding and cutting, together with transparent sheets which are positioned in the arrangement so that the working operation can be controlled/performed from the outside of the arrangement.

The present invention will be further explained with reference to the following claims and Figures, wherein:

FIGS. 9 A–D shows how an opening surrounds an object of varying size in that there are arranged spring-loaded lips in the opening.

Figure 10:
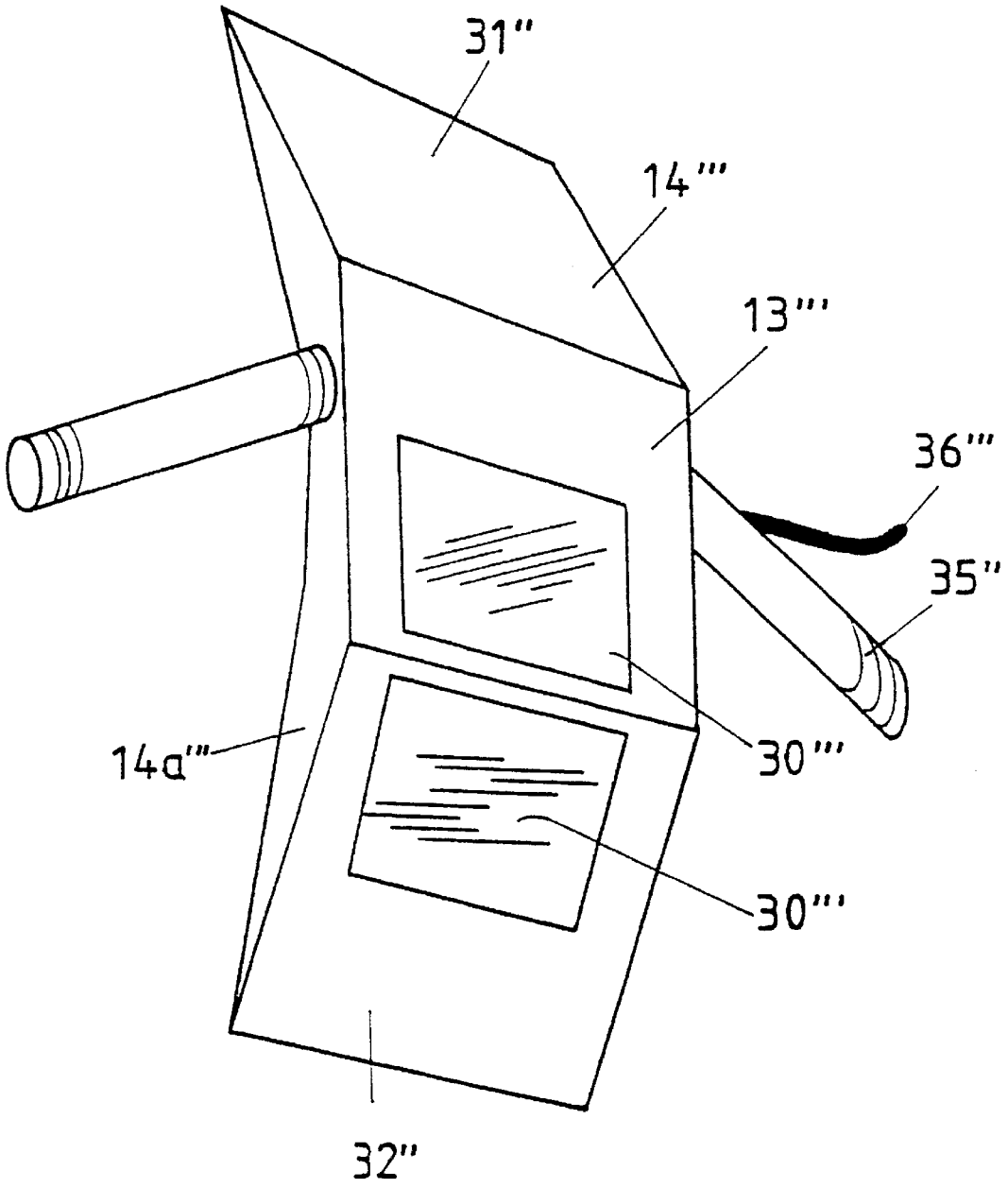

FIG. 10 shows another embodiment of the invention, where the arrangement is equipped with a handle.

Figure 1:
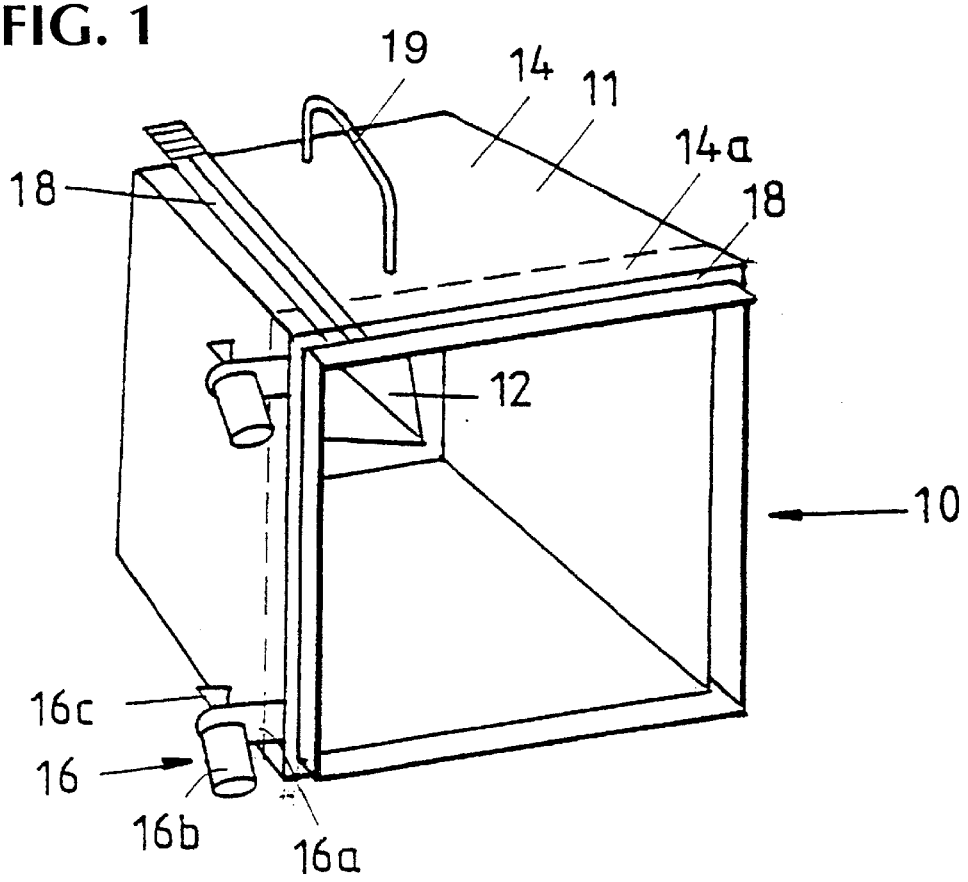
FIG. 1 shows in perspective an example of an arrangement according to the invention, illustrated obliquely from above.
Figure 2:
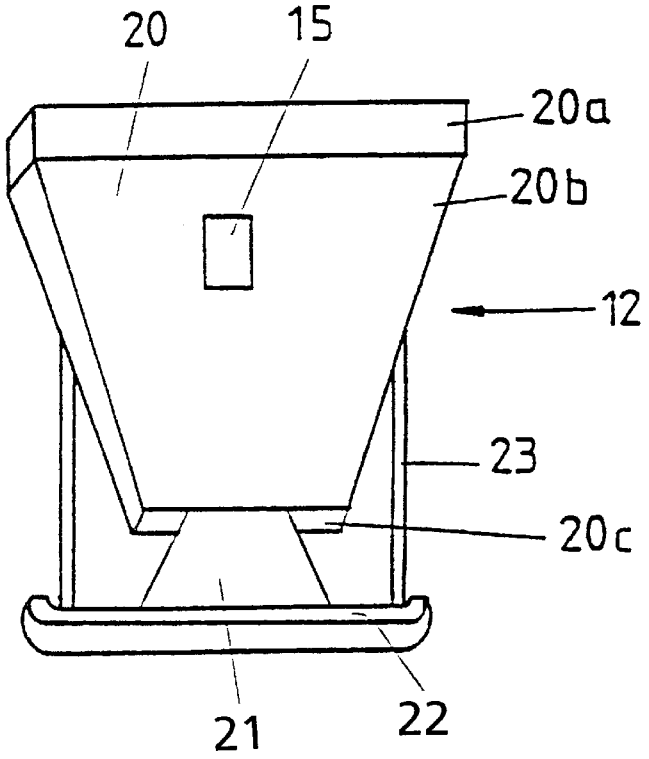
FIG. 2 shows the arrangement according to FIG. 1 and its inner part seen in perspective from the side.
Figure 3:
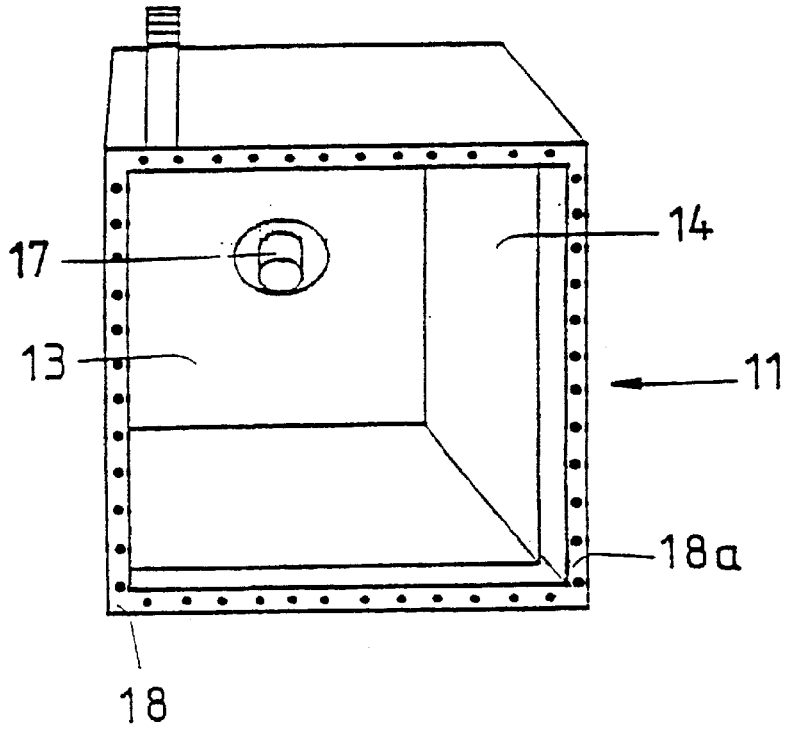
FIG. 3 shows the arrangement according to FIGS. 1–2 and its housing portion seen in perspective from above.

FIG. 1 shows an arrangement 10 for receiving sparks, solid articles, gases and smoke in connection with welding and cutting operations of dissimilar materials. The arrangement 10 can be used on all types of material which emit gases and/or particles, but is preferably designed for various metals/metal alloys. The arrangement is composed of two parts, namely a housing portion 11 and an inner part 12. The housing portion 11 is shown in FIG. 3 and the inner part is shown in FIG. 2.

In the concrete embodiment which is indicated in FIGS. 1–4 the housing portion 11 is formed of a bottom part 13 and four wall portions 14, which stretch substantially vertically relative to the horizontal bottom part 13. The wall portions 14 are arranged slightly sloping outwards, that is to say that the opening has a larger periphery than the bottom portion 13. The uppermost region of the wall portions 14, namely the portions 14*a* are bowed so that they extend approximately at right angles relative to the bottom portion 13. The housing portion 11 has a design and dimensions which are adapted for the reception of the inner part 12.

On one or more of the walls 14 there are arranged attachments 15 for the reception and positioning of the inner part 12, so that this can be latched in place in the housing portion 11 since outer sides of the inner part 12 are equipped with oppositely acting fastening means 15*a*. The positioning of the inner part 12 in the housing portion 11 enables between the two parts, at least an the region uppermost in the wall portions 14*a* of the housing portion 11, In order to make FIG. 4 more clear the portions 14*a* and 20*a* are indicated at a certain distance.

The housing portion 11 is equipped with a number of fastening means 16 for fastening to a suitable work location. This can be on the under side of for example a metal plate which is in the course of being finished, it being either welding or cutting. In the concrete embodiment which is shown in FIG. 1 magnets are indicated as fastening means 16. On outer walls 14 of the housing portion 11 a set of fastening ears 16*a* are arranged. To the fastening ears 16*a* magnets 16*b* are fastened via adjustable fastening screws 16*c*. Other fastening means 16 can also be employed, such as suctions cups or spot welds.

In the housing portion 11, through the bottom part 13, an exit 17 is arranged. To this exit 17 is mounted, via a rapid coupling, a vent so that gases and smoke are effectively sucked out of the arrangement 10. In an embodiment there are used means (not indicated in the Figures), such as a packing attached to the uppermost edge of the wall portion 14*a*, in order to ensure a sealing joint between the arrangement 10 and for example the metal plate which is in the course of being finished. This ensures that the vent functions effectively, and approximately all the gas and smoke which is formed will be sucked into the vent via the arrangement 10.

Figure 4:
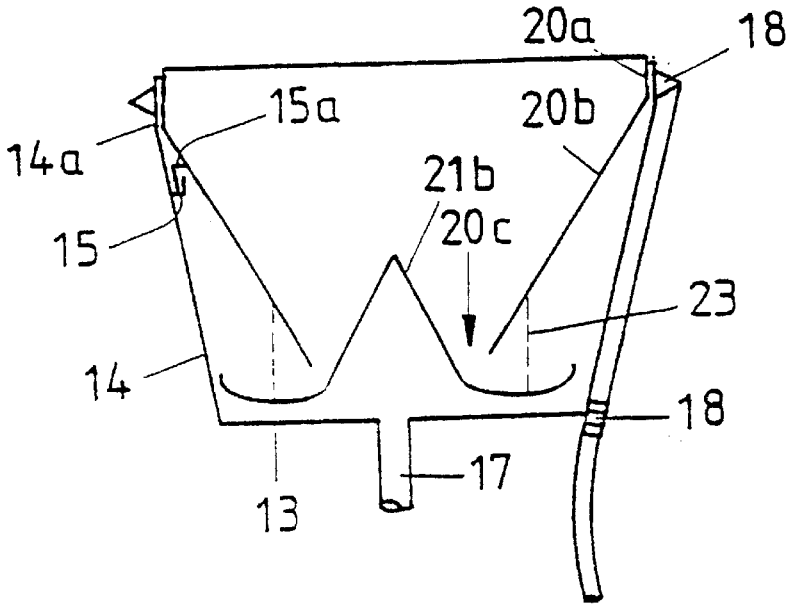
FIG. 4 shows a section of a cross-section of an embodiment according to FIGS. 1–3 where the arrangement is provided with ducts for conducting cooling medium.

The housing portion 11 is also equipped with cooling means 18. In the concrete embodiment which is illustrated in FIGS. 1, 3 and 4 a longitudinal angle section is fastened to the outside of outer walls 14 of the housing portion 11. This involves ducts 18 being formed. These ducts can also be formed by triangular sections, U-sections and pipes and the like. The ducts 18 are arranged with an entrance portion 18*a* near the bottom 13 of the housing portion 11. Through these ducts 18 there flows a cooling fluid, for example cold water, liquid nitrogen and the like. The ducts 18 stretch further upwards along one or more walls 14, and as shown in FIGS. 1, 2 and 4 they surround the periphery of the housing portion 11 in a region in the vicinity of the wall portions 14*a*. In this manner the housing portion 11 is cooled, and by virtue of the direct contact with the inner part 12, this is also cooled.

In individual regions, preferably uppermost on the housing portion 11, the ducts 18 can be arranged with small openings 18*a* so that cooling fluid, such as water escapes from the ducts 18. Alternatively, and not indicated further in the Figures, the ducts 18 are provided with an outlet portion which the water is led out through. Thus Fresh cold water will constantly come into the arrangement 10, receive some heat from the arrangement 10, and thereafter be removed. It is preferred, but not the only solution, that the flow through of water takes place upwards, that is to say against the force of gravity.

Figure 5:
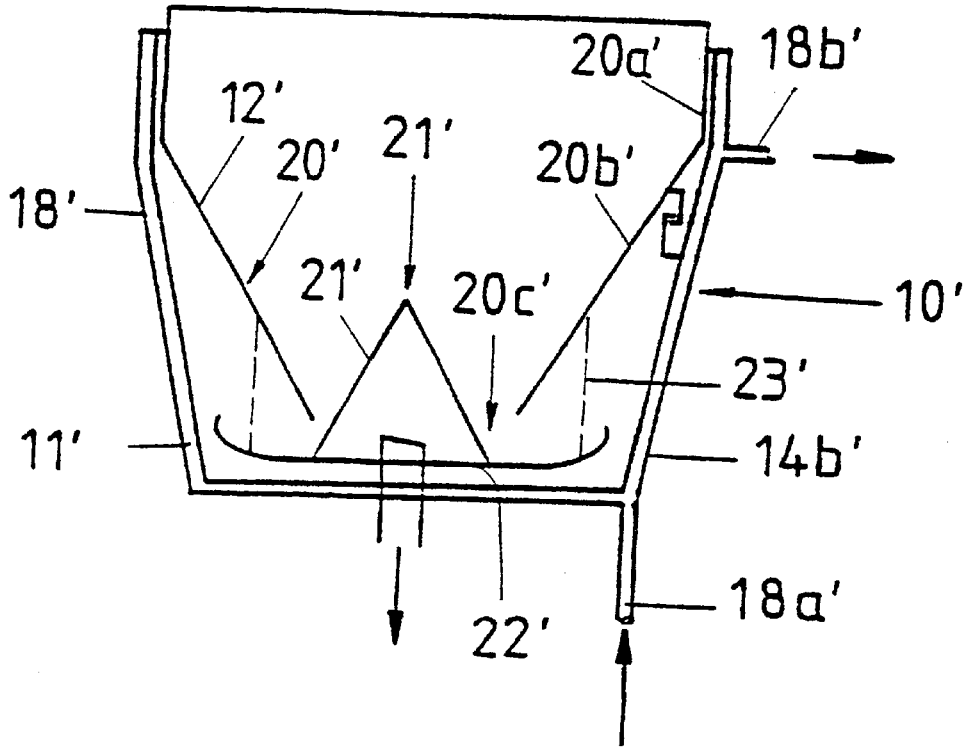
FIG. 5 shows in a section of a cross-section an another embodiment of the arrangement where the cooling medium is conducted in a set of double walls.

In a concrete embodiment which is illustrated in FIG. 5 housing portion 11' of the arrangement 10' is provided with a set of double walls 14*b'*. This leads to water circulating between the double walls 14*b'* over the whole external upper surface of the housing portion 11'. This gives an effective cooling of the housing portion 11', and via this also the inner part 12'. There are arranged, in a corresponding manner as explained above, an entrance portion 18*a'*, preferably in the bottom of the housing portion 11', and an exit portion 18', preferably in the top of the housing portion 11'. The entrance and exit portions 18*a'*, 18*b'* are equipped with rapid couplings not indicated further.

The housing portion 11,11' can further be equipped with means, such as a handle 19, so that it can be easily transported, and also positioned to for example the metal plate which is to be finished.

FIG. 2 illustrates the inner part 12 which functions as an energy-reducing means for reducing the speed and the energy of spark particles. As illustrated, the inner part 12 includes two pyramids, namely a larger pyramid 20 with the apex directed downwards and a smaller pyramid 21 with the apex directed upwards. The pyramid 20 is open at both ends, that it to say pyramid stump shaped. The widest portion of the pyramid 20, which faces upwards, has a periphery which is somewhat less than the opening of the housing portion 11 so that the inner part 12 is received in the housing portion simultaneously with contact being established between the two portions 11,12. The pyramid 20 is therefore constructed with substantially vertical walls 20*a*, together with a wall portion 20*b* with sloping walls. As mentioned the apex of the pyramid 20 is open at the top so that an opening 20*c* is formed. Through this opening 20*c* passes then the smaller pyramid 21, with the apex upwards, a distance into the pyramid 20. There are still openings between the two pyramids 20,21 on all sides. The lowermost pyramid 21 is fastened to a saucer-shaped portion 22. In a concrete embodiment the transition between the pyramid 21 and the saucer-shaped portion 22 is rounded as is shown in FIG. 4, in order to ensure effective deflection of sparks.

Fastening means 23 are arranged in order to position the two pyramids 20,21 relative to each other. FIG. 4 and FIG. 5 show in a section of a cross-section how the two pyramids 20,21 can be positioned relative to each other.

The pyramids can also be designed with fewer or more than four walls, or for example have a conical form. That which is important is that the walls are obliquely disposed relative to the flow of sparks.

Figure 6:
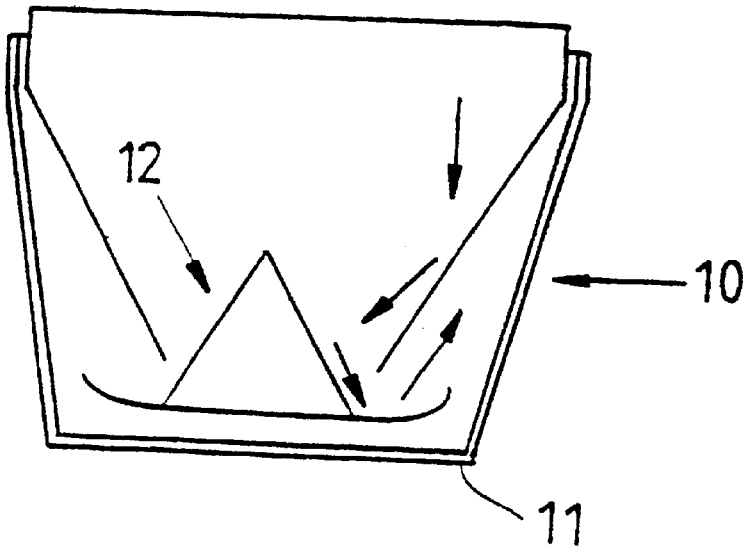
FIG. 6 shows with arrows the principle as to how sparks are led through the arrangement 10.

On cutting burning sparks are formed. If they are not shielded these can kick about 4–5 metres. The object of the specific design of the pyramids 20,21 is to be able to absorb these sparks, and also to reduce their speed and cool them. This is done by the sparks not colliding at right angles against a surface, but instead striking the surface obliquely so that the direction is changed, and the sparks are deflected. Thus the speed will be reduced at the same time as only a smaller part of the energy/heat of the sparks is transferred to the inner part 12. FIG. 6 shows with arrows how the current of sparks will move in the arrangement 10. First the spark flow strikes the inside of the pyramid 20 where the direction is deflected. Thereafter the sparks will strike the saucer portion 22, be deflected and the flow of sparks is led further up between the outside of the pyramid 20 and the inside of the walls 14 of the housing portion 11. Here the current of sparks is stopped, and additionally cooled. In this way the heat (the energy) of the sparks is reduced gradually. The cooling fluid which is supplied to the arrangement 10 will see to the housing portion 11 and the inner portion 12 which are in contact with the sparks being sufficiently cooled.

A particularly favourable embodiment of an arrangement 10 according to the invention has a rectangular design. That is to say that the opening, which faces towards the metal plate which is finished, has a length which is greater than the breadth. This ensures that longer stretches can be welded/cut without the arrangement having to be moved. Another example comprises an arrangement which has in the main an L-shape, so that there can be cutting/welding for example around a corner.

The forms of construction which are explained above and indicated in FIGS. 1–6 are designed for welding/cutting on flat materials, and where the arrangement 10, 10' is positioned on the under side of the work area, so that the sparks and the gases are led into, and through the arrangement 10,10'.

Below an arrangement 10",10'" is described for application on curved surfaces, such as a pipe. The object is the same, namely that the arrangement 10",10'" shall be able to be easily moved from one work location to another, and also absorb the waste gases which are formed in connection with welding/cutting. In addition the apparatus shall shield the rain of sparks.

Figure 7:
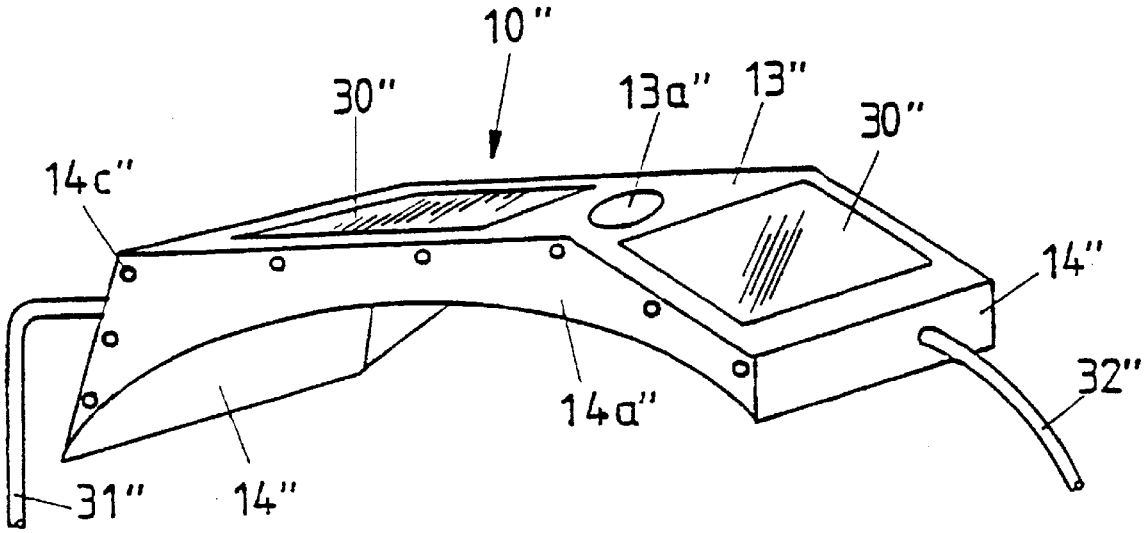
FIG. 7 shows an embodiment of the arrangement which is especially applicable for welding/cutting burning of materials with curves.
Figure 8:
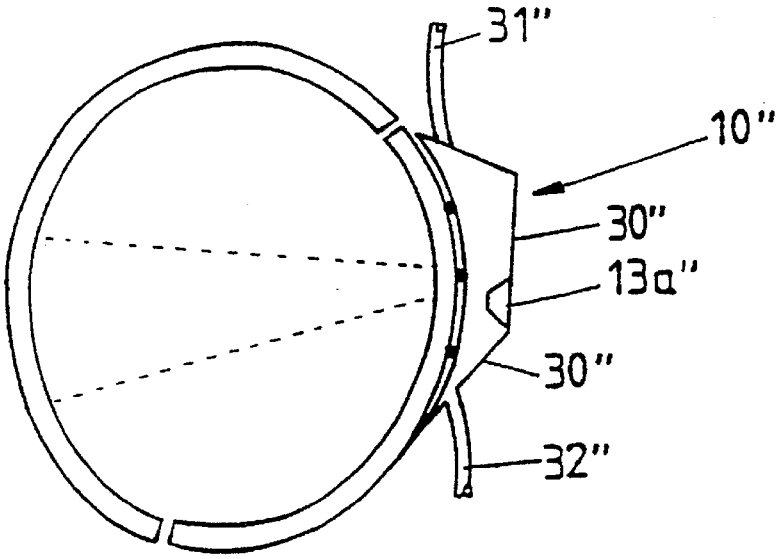
FIG. 8 shows an arrangement approximately the same as that in FIG. 7 in a section of a cross-section, where the arrangement is positioned on the outside of a pipe.

In the embodiment which is indicated in FIGS. 7,8,10 the arrangement comprises a housing consisting of a bottom portion, and to this a set, preferably two, of permanently mounted opposing walls. Additionally two walls are however detachable and can be easily replaced so that they can be adapted to for example pipes of dissimilar diameter.

In contrast to the embodiments shown in FIGS. 1–6 the arrangement 10" is positioned on the upper side/outside of the material which is finished, that is to say above the work area, in such a manner that the welding/cutting takes place within the arrangement 10" Per se.

FIG. 7 shows an embodiment of such an arrangement 10". This can be made of a plate which is bent so that wall portion(s) 14", and root portion(s) 13" are formed. The wall portion(s) 14" and the roof portion(s) 13" can be dissimilarly disposed obliquely as is shown in FIG. 7. Two opposite walls 14*a*″ are detachable from wall/roof portions 14",13" so that they can be readily replaced. The wall portions 14*a*″ are formed thus with openings 14*b*″ of various dimensions/diameters, that is to say with different curvatures so that they surround pipes of dissimilar diameter. There can also be installed wall portions 14*a*″ so that the whole opening 14*b*″ is covered if the arrangement 10" is to be used on a flat base.

The wall/roof portion(s) 14",13" are equipped with means 14*c*″ in order to form rapid fastenings/latch engagements with the wall portions 14*a*″.

The arrangement 10" comprises further one or more flexible openings 13*a*″ in the wall or roof portions 13",14", 14*a*″ so that equipment for cutting burning/welding can be guided through. Such a flexible opening 13*a*″ can be formed of a set of movable lips 13*b*″ as indicated in FIGS. 9A–D. These lips 13*b*″ will envelop equipment of dissimilar form, and also provide for tight enveloping when the equipment moves.

The arrangement 10" is further equipped with a number of transparent panels 30", positioned and adapted so that the work area is easily visible for the worker. In FIG. 7 two such transparent panels are indicated, where the one is the most suitable in connection with welding, and the other for cutting.

Furthermore the arrangement 10" is provided with coupling points for respectively sub-atmospheric pressures 31" and super-atmospheric pressures 32". The super-atmospheric pressure is used in order to prevent the admission of explosive gases, and in order to get a better through flow of new air, while the sub-atmospheric pressure removes smoke, gases and particles. Both the sub-atmospheric pressure and the super-atmospheric pressure will reduce the temperature in the work area.

The arrangement 10" thus ensures that a closed off and approximately gas-tight space is formed over the welding/cutting operation. The arrangement 10" is extremely flexible and on replacement of the wall portions 14*a*″ can be used for all grades of curving, such as pipes of any dimension, as well as flat surfaces.

The arrangement 10" is equipped with a set of fastening means (not shown) for fastening of the arrangement 10" to the base.

As is evident from FIG. 10 the arrangement 10'" can be equipped with a number of handles 35'" adapted so that the arrangement 10'" can be easily moved in dissimilar directions, for example alongside a pipe. This is particularly favourable for example if the equipment for welding/cutting is permanently mounted to the arrangement 10",10'", since the handles 35'" result in the equipment being easily movable from position to position, that is to say that the arrangement 10",10'" is moved gradually as the work progresses forward. In FIG. 10 is seen an inlet pipe 36'" which conducts in acetylene and oxygen in connection with welding. The welding equipment is mounted on the inside of the arrangement 10'".

In a corresponding manner as for the arrangement 10,10' which is indicated in FIGS. 1–6, the arrangement 10", 10'" in FIGS. 7,8 and 10 is provided with ducts or double walls for conducting cooling medium.

As is evident from FIG. 8 the interior of the pipe which is finished will function as a spark catcher, as the pyramids 20,21 function in the arrangement 10,10'. The object of the invention is to obtain a simple, compact and small spark and smoke catcher, which hence is mobile, and which effectively removes gases and smoke, and also absorbs gases and solid particles which are formed by welding and cutting burning.

What is claimed is:

1. An apparatus for removing gases and particles comprising a housing having a plurality of circumferentially disposed walls defining an open end for facing a workpiece;

an energy reducing means in said housing for reducing the speed and energy of spark particles, said means including a first pyramid-shaped element disposed in said housing in spaced relation to said walls with a first open end facing said open end of said housing to receive a flow of material from the workpiece and a second open opposite end, and a second pyramid shaped element disposed in said housing with a closed apex end concentrically within said second open end of said first pyramid-shaped element to define a gap therebetween and to deflect the flow of material into said gap, said second pyramid shaped element being spaced from said walls of said housing; and a suction unit connected to said housing for withdrawing a flow of material from between said first pyramid shaped element and said housing walls.

2. An apparatus as set forth in claim 1 which further comprises cooling means on said housing for cooling the contents of said housing.

3. An apparatus as set forth in claim 1 wherein said second pyramid shaped element has a saucer shaped annular edge for directing a flow of material passing through said gap towards said walls of said housing.

4. An apparatus as set forth in claim 1 wherein said energy reducing means is in heat transfer contact with said housing to transfer heat thereto and which further comprises cooling means on said housing for cooling the contents of said housing.

5. An apparatus as set forth in claim 1 further comprising means on said housing for securing said housing to a workpiece to direct a flow of material from the workpiece into said energy reducing means in said housing.

* * * * *

UNITED STATES PATENT AND TRADEMARK OFFICE

CERTIFICATE OF CORRECTION

PATENT NO. : 6,332,837 B1
DATED : December 25, 2001
INVENTOR(S) : Vidar Wiik et al.

It is certified that error appears in the above-identified patent and that said Letters Patent is hereby corrected as shown below:

Title page,
Item [76], Inventors, change "Wilk" to -- Wiik --

Column 1,
Line 10, after "operation" insert -- . --
Line 18, change "Formed" to -- formed --
Line 33, change "auction" to -- suction --

Column 2,
Line 60, change "an" to -- in --

Column 3,
Line 41, change "Fresh" to -- fresh --

Column 5,
Line 11, change "Per" to -- per --
Line 14, change "root" to -- roof --

Signed and Sealed this

Tenth Day of September, 2002

*Attest:*

*Attesting Officer*

JAMES E. ROGAN
*Director of the United States Patent and Trademark Office*